US006875912B2

(12) United States Patent
Gatzen

(10) Patent No.: US 6,875,912 B2
(45) Date of Patent: Apr. 5, 2005

(54) DRUM BEATER WITH CONTROLLABLE BEATING CAPABILITY

(76) Inventor: Robert Gatzen, 157 Pheasant Run, Newington, CT (US) 06111

( * ) Notice: Subject to any disclaimer, the term of this patent is extended or adjusted under 35 U.S.C. 154(b) by 0 days.

(21) Appl. No.: 10/428,677

(22) Filed: May 5, 2003

(65) Prior Publication Data

US 2004/0221706 A1 Nov. 11, 2004

(51) Int. Cl.[7] ..... G10D 13/02

(52) U.S. Cl. ..... 84/422.4; 84/422.1; 84/422.2; 84/422.3

(58) Field of Search ..... 84/422.4, 422.1, 84/422.2, 422.3

(56) References Cited

U.S. PATENT DOCUMENTS

| | | | | |
|---|---|---|---|---|
| 2,586,163 A | | 2/1952 | Heiderich et al. | |
| 2,896,492 A | | 7/1959 | Dane | |
| 3,411,395 A | | 11/1968 | Hanes | |
| 5,610,351 A | * | 3/1997 | Yanagisawa | 84/422.1 |
| 5,763,798 A | | 6/1998 | Chen | |
| 6,180,860 B1 | | 1/2001 | Chen | |

* cited by examiner

*Primary Examiner*—Shih-Yung Hsieh
(74) *Attorney, Agent, or Firm*—William W. Haefliger

(57) ABSTRACT

A drum beater comprising an elongated stem, and a beater head carried by the stem, and having a relatively hard drum striker, a relatively soft drum striker, both of said strikers facing in the same direction, to strike a drum head.

17 Claims, 4 Drawing Sheets

DRUM BEATER WITH CONTROLLABLE BEATING CAPABILITY

BACKGROUND OF THE INVENTION

This invention relates generally to control of striking of percussion instruments, and more particularly to an improved beater construction facilitating enhanced control of striking of drums and drum heads.

During beating of a drum, a drummer may seek to control the movement of a beater or mallet to vary its impact with a drum head, for example to produce a softer or louder sound, or otherwise variable sound. This control is made more difficult by the construction of beaters that present a uniform beating surface to the drum.

There is need to overcome this difficulty or problem, and in such a way as to enhance controllability as well as to increase the range of tones producible by drumming.

SUMMARY OF THE INVENTION

It is a major object of the invention to provide a solution to the above described problems and difficulties, as well as to provide an improved beater construction. The improved beater of the invention comprises, a) an elongated stem, and b) a beater head carried by the stem, and having:

i) a relatively hard drum striker ii) a relatively soft drum striker, c) both of said strikers facing in the same direction, to strike a drum head.

As will be seen, the relatively soft striker may consist of resiliently compressible material; and the relatively hard striker may be metallic, or of other hard material. Further, the relatively soft striker may consist of cushioning material formed as a block or blocks, and may extend at opposite sides of the metallic striker to yieldably engage a drum head to substantially equal extents at opposite sides of the hard striker.

Another object is to provide a relatively hard striker forming a drum striking surface having first and second portions facing forwardly, said first portion protruding forwardly relative to said second portion. Such first and second portions may define a dome that is forwardly facing and may be forwardly convex. In this regard, the relatively soft striker may extend at opposite sides of the relatively hard striker to face sidewardly and openly toward angled extents of the hard dome.

Apparatus to swing the hard and soft striker forwardly may include a pivoted foot plate, an axle supporting the stem, and structure operatively connecting the foot plate and axle to rotate the axle in response to displacement of the foot plate.

Yet another object is to provide an adjuster operable to adjust the relative positions of the strikers. As will be seen, a base may be provided, and to which the relatively soft striker is connected, the adjuster being rotatable relative to the base to advance or retract the relatively hard striker relative to the relatively soft striker.

These and other objects and advantages of the invention, as well as the details of an illustrative embodiment, will be more fully understood from the following specification and drawings, in which:

DRAWING DESCRIPTION

FIG. 1 is a side elevation view of a beater head incorporating the invention;

FIG. 1*a* is like FIG. 1, but shows a modification;

DETAILED DESCRIPTION

Figure 1:
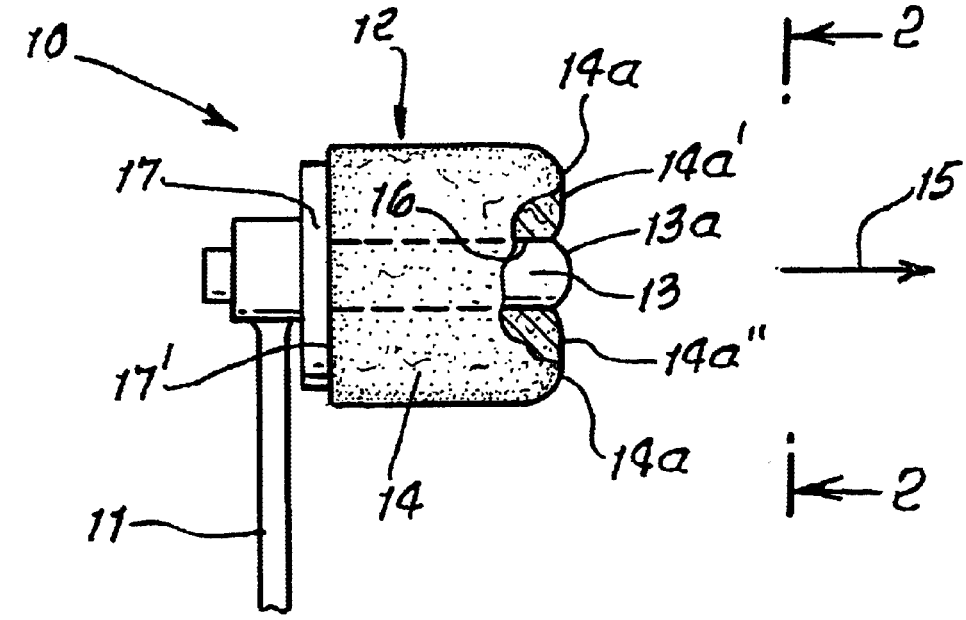
Figure 2:
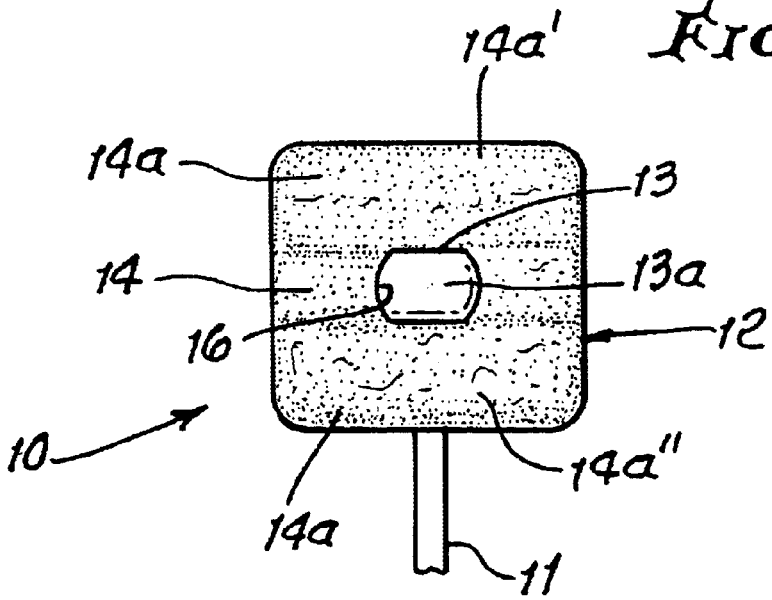
FIG. 2 is a front elevation taken on lines 2—2 of FIG. 1.

FIGS. 1 and 2 show a drum beater or mallet 10 having an elongated stem 11 and a beater head 12 carried by the stem. The head 12 includes a relatively hard, as for example metallic drum striker 13, and a relatively soft drum striker 14. Both face in the same direction indicated by arrow 15 to strike a drum head, as the stem 11 moves in that direction. Striker 13 has a hard surface 13*a* facing in direction 15, and striker 14 has a soft surface or surfaces 14*a* facing in direction 15. The striker 14 and surface 14*a* may consist of resiliently compressible foam rubber, or other elastomeric material, or felt, and surface or surfaces 14*a* extend or extends at opposite sides (for example above and below) striker surface 13*a*. Note upper surface extent 14*a'*, and lower surface extent 14*a"*, which are generally alike, whereby induced deflection of a drum head by simultaneous impact of surfaces 13*a*, 14*a'* and 14*a"* may be substantially balanced. Striker 14 may comprise a block of compressible material forming an opening or bore 16 in which metallic striker 13 projects forwardly, from a base 17, to which striker 14 may be attached at 17'. Surface 13*a* may comprise metal, plastic, wood, or other material significantly harder than foam rubber.

Figure 4:
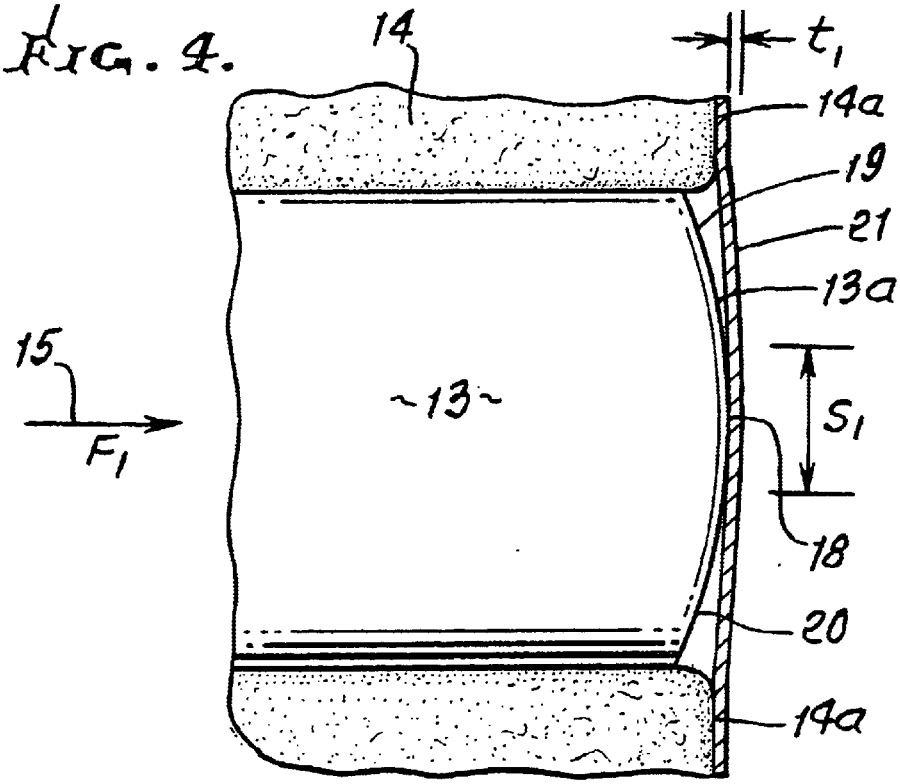
FIG. 4 is an enlarged vertical section showing impact of the beater head with a drum head in response to controlled force $F_1$ application.
Figure 5:
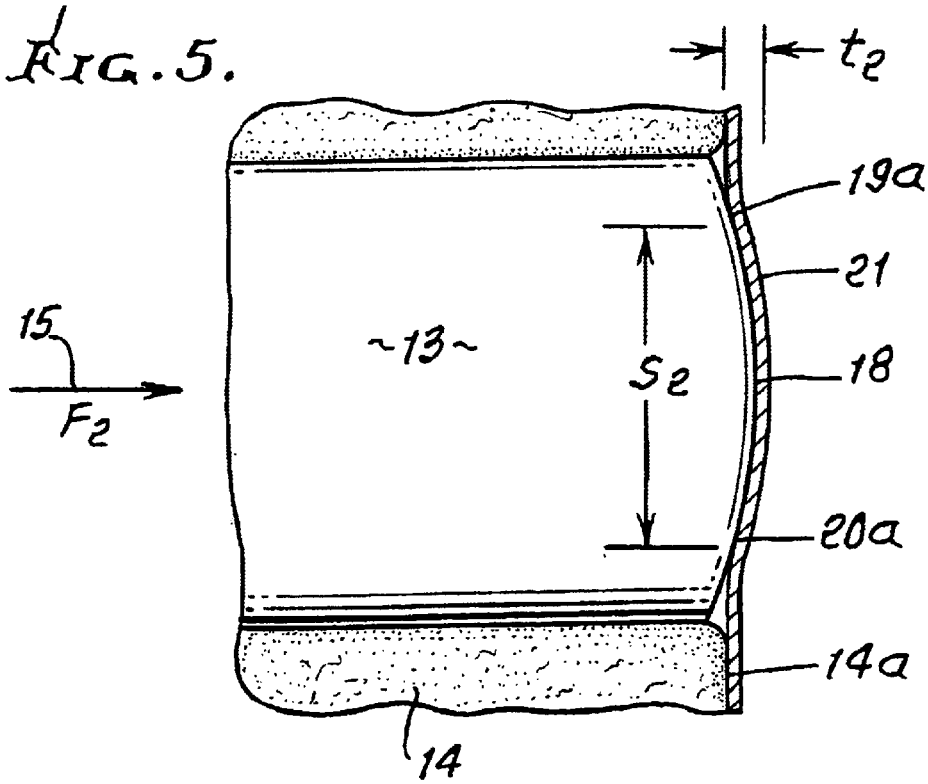
FIG. 5 is a view like FIG. 4, showing beater head impact in response to force $F_2$ application.

Referring now to FIGS. 4 and 5, the hard surface 13*a* has first and second portions facing forwardly, the first such portion protruding forwardly relative to the second portion. One way this is effected is by shaping such first and second portions in the form of a dome facing forwardly. See for example dome first portion 18 defining a crest, and dome second portions 19 and 20 at opposite sides of 18, and angled or sloping rearwardly, whereby 18 protrudes forwardly relative to 19 and 20. The dome preferably may form a curved surface, shown. Surfaces 19 and 20 may be alike in extent, curvature and angularity.

FIG. 4 shows the condition where the drum head 21 is impacted with lesser force $F_1$, by the beater head. The compressible striker is resiliently compressed by amount or amounts $t_1$ both above and below the crest 18 of the metallic striker, and only that crest portion of lateral dimension $S_1$ crosswise of the striker engages the drum head, to produce a relatively soft sound.

FIG. 5 shows the condition where the drum head 21 is impacted with greater force $F_2$ ($F_2$ exceeds $F_1$), by the beater head. The compressible striker is resiliently compressed by amount or amounts $t_2$ (where $t_2$ exceeds $t_1$), both above and below the crest 18 of striker 13. Not only crest 18, but also portions 19*a* and 20*a* of 19 and 20 engage the drum head, to produce a relatively louder sound. The dome surface extent of wider dimension $S_2$ now impacts the drum head. In this regard, the compressibility of striker 14, at surfaces 14*a*, controls the extent to which the convex surface of the dome of 13 impacts the drum head.

Figure 3:
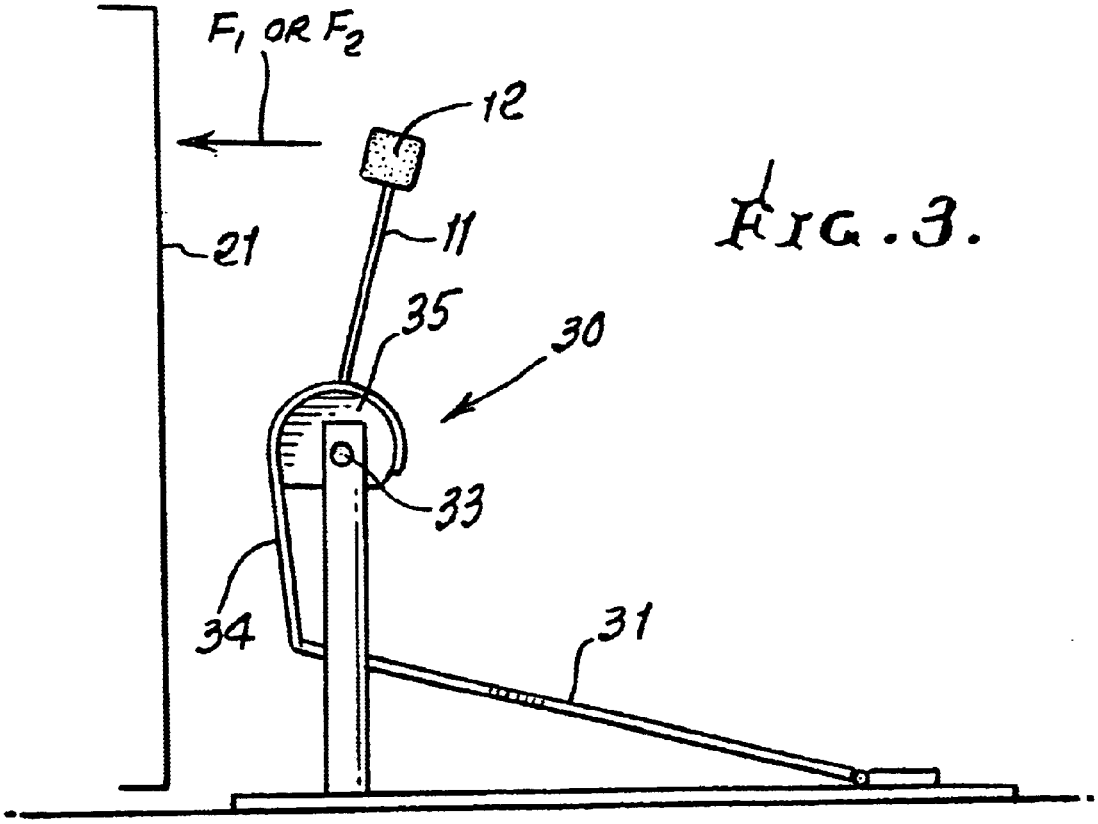
FIG. 3 is a schematic view of apparatus to swing the FIGS. 1 and 2 drum beater toward a drum head.

FIG. 3 schematically shows one form of apparatus 30 applicable to swing the beater head and stem in a forward direction toward a drum, as the drummer's foot depresses a pivoted foot plate 31, with controllable force, i.e. to produce selected forces $F_1$ and $F_2$ described above. Other controllable forces are of course usable.

Apparatus 30 also includes an axle 33 supporting the stem 11, as well as structure 34 (such as a belt or chain) connecting the forward portion of the plate 31 to a hub or sprocket 35 on axle 33, as is known.

Figure 1A:
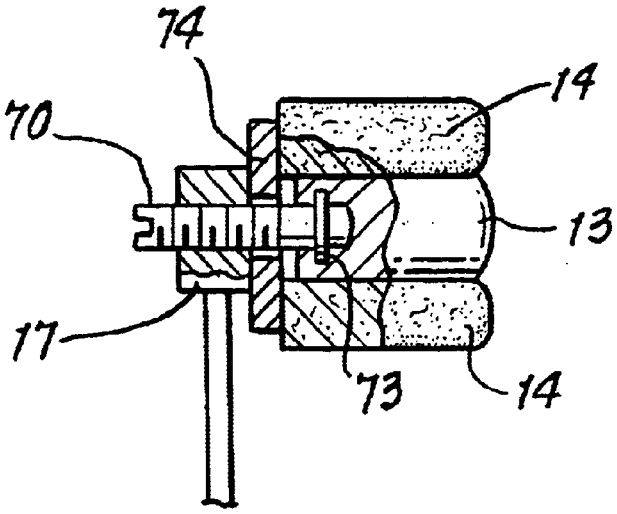

FIG. 1*a* shows a capability for adjustment of the position of striker 13 relative to striker 14, in the forward direction. An adjuster 70 is rotatable to advance or retract 13 relative to 14. Adjuster may have threaded engagement to base 17, so that it moves axially, with the striker 13, as it is rotated. Coupling of the striker to the adjuster is indicated at 73. Striker 14 is attached to the base at 74.

Figure 6:
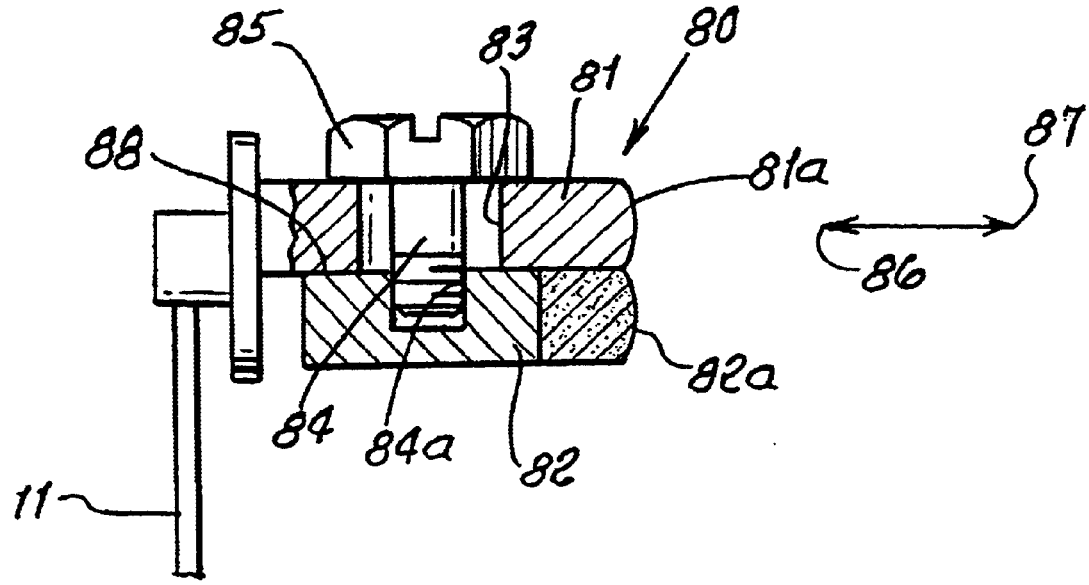
FIGS. 6 and 7 show modifications.

In the modification of FIG. 6, a beater head 80 is carried by stem 11. Head 80 includes upper and lower plates 81 and 82. Plate 81 defines a relatively hard striker or drum striking surface 81*a*; and lower plate 82 carries a relatively soft, compressible striker, or drum striking surface 82*a*. A slot 83 is formed in plate 81, and a threaded fastener stem 84 projects downwardly through the slot into threaded bore 84*a* in plate 82. When head 85 of the fastener is rotated in one direction, plate 82 is loosened and can be shifted endwise in direction 86 or direction 87, to adjustably position surface 82*a* relative to surface 81*a*. When head 85 is rotated in the opposite direction, the plates are clamped together at interface 88. If surface 82*a* projects forwardly of surface 81*a*, the drum head is first struck by 82*a* and then by hard surface 81*a*. The extent to which compressible surface 82*a* project forwardly of 81*a* determine the impact of the drum head by 82*a* and 81*a*, and therefore the resultant sound.

Figure 7:
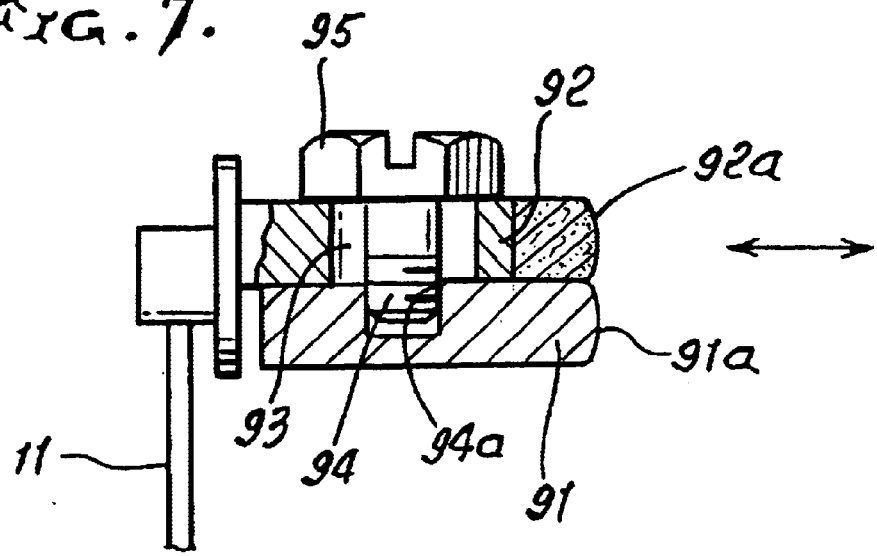

FIG. 7 shows a reverse construction. Lower plate 91 now defines the relatively hard striker, or drum striking surface 91*a*; and upper plate 92 carries a relatively soft compressible striker, or drum striking surface 92*a*. Slot 93 is formed in plate 92, and threaded fastener stem 94 projects downwardly through the slot into threaded bore 94*a* in plate 91. Plate 91 can be adjustably shifted when the fastener head 95 is loosened, and fixedly positioned when the head is tightened. The extent to which compressible surface 92*a* projects forwardly of hard surface 91*a* determines the the impact of surfaces 91*a* and 92*a* against the drum head, and the resulting sound.

I claim:

1. A drum beater comprising, in combination:

a) an elongated stem, and b) beater head carried by the stem, and having:
i) a relatively hard drum striker
ii) a relatively soft drum striker c) both of said strikers having faces with major extents facing in the same direction, to strike a drum head, d) and oriented with striker faces in substantially side-by-side relation to cause both striker faces to strike the drum head substantially simultaneously, at sufficient beater head force.

2. The combination of claim 1 wherein said relatively soft striker comprises resiliently compressible material.

3. The combination of claim 2 wherein said relatively hard striker comprises material substantially harder than foam rubber.

4. The combination of claim 1 wherein said relatively soft striker extends at opposite sides of said relatively hard striker.

5. The combination of claim 4 wherein said relatively soft striker comprises a block of cushioning material.

6. The combination of claim 1 wherein said relatively hard striker defines a drum striking surface having first and second portions facing forwardly, said first portion protruding forwardly relative to said second portion.

7. The combination of claim 6 wherein said first and second portions define a forwardly facing dome.

8. The combination of claim 7 wherein said dome is forwardly convex.

9. The combination of claim 8 wherein said relatively soft striker extends at opposite sides of the relatively hard striker to face toward angled extents of the dome.

10. The combination of claim 9 wherein said apparatus includes a pivoted foot plate, an axle supporting the stem, and structure operatively connecting the foot plate and axle to rotate the axle in response to displacement of the foot plate.

11. The combination of claim 1 including foot operated apparatus to swing said head and stem in a forward direction toward a drum.

12. A drum beater comprising, in combination:

a) an elongated stem, and b) a beater head carried by the stem, and having:
i) a relatively hard drum striker
ii) a relatively soft drum striker c) both of said strikers facing only in the same direction, to strike a drum head, d) and including an adjuster operable to adjust the relative positions of the strikers.

13. The combination of claim 12 wherein said adjuster has a rotatable element that advances or retracts one of the strikers relative to the other striker.

14. The combination of claim 12 including a base to which the relatively soft striker is connected, the adjuster being rotatable relative to the base to advance or retract the relatively hard striker relative to the relatively soft striker.

15. A drum beater comprising, in combination:

a) an elongated stem, and b) a beater head carried by the stem, and having:
iii) a relatively hard drum striker
iv) a relatively soft drum striker c) both of said strikers facing in the same direction, to strike a drum head, d) and wherein the beater head includes two relatively adjustable plates, one plate carrying the relatively hard striker, and the other plate carrying the relatively soft striker.

16. The combination of claim 15 including a fastener tightenable to fix the positions of the two plates, and loosenable to allow relative shifting of the two plates.

17. The combination of claim 16 including a slot in one plate to receive a stem defined by the fastener, the stem attached to the other plate.

* * * * *